US006093087A

United States Patent [19]

Hakomori et al.

[11] Patent Number: 6,093,087

[45] Date of Patent: Jul. 25, 2000

[54] WAFER PROCESSING MACHINE AND A PROCESSING METHOD THEREBY

[75] Inventors: Shunji Hakomori; Masahiro Ichikawa; Kenji Amano, all of Ayase, Japan

[73] Assignee: SpeedFam Co Ltd, Kanagawa-Pref, Japan

[21] Appl. No.: 09/262,039

[22] Filed: Mar. 4, 1999

[30] Foreign Application Priority Data

Mar. 5, 1998 [JP] Japan ..... 10-053408

[51] Int. Cl.[7] ..... B24B 1/00

[52] U.S. Cl. ..... 451/57; 451/44; 451/262

[58] Field of Search ..... 451/41, 43, 44, 451/57, 63, 65, 66, 259, 262, 268, 269, 270, 285, 287, 288, 58, 60, 37

[56] References Cited

U.S. PATENT DOCUMENTS

| | | | |
|---|---|---|---|
| 4,344,260 | 8/1982 | Ogiwara | 451/44 |
| 4,393,628 | 7/1983 | Ottman et al. | 451/63 |
| 5,289,661 | 3/1994 | Jones et al. | 451/44 |
| 5,486,134 | 1/1996 | Jones et al. | 451/63 |
| 5,725,414 | 3/1998 | Moinpour et al. | 451/44 |
| 5,755,613 | 5/1998 | Uchida et al. | 451/63 |
| 5,868,857 | 2/1999 | Moinpour et al. | 451/44 |
| 5,944,584 | 8/1999 | Toyama | 451/43 |

*Primary Examiner*—Derris H. Banks

[57] ABSTRACT

The invention relates to a sheet feeding type wafer polishing machine which processes both surfaces of the wafer and outermost periphery of the wafer (edge part) in series, having two platens which are adhered to a polishing pad or a grinding stone and holding a wafer therebetween. The surface of the wafer is processed by rotating at least one of the two platens and wafer, wherein the diameters of the platens are bigger than the radius of the wafer and smaller than the diameter of the wafer, and the wafer is supported by at least three guide rollers which contact to the outermost periphery of the wafer. The present invention also provides an edge polishing and a surface polishing method which are carried out by the wafer processing machine.

5 Claims, 2 Drawing Sheets

WAFER PROCESSING MACHINE AND A PROCESSING METHOD THEREBY

BACKGROUND OF THE INVENTION

1. Field of the Invention

The present invention relates to a sheet feeding type wafer polishing machine, and specifically relates to a sheet feeding type polishing machine which processes both surfaces of the wafer and outermost periphery of the wafer (edge part) in series. More specifically the present invention relates to a sheet feeding type polishing machine which polishes both surfaces and edge part of a wafer bigger than 12 inches diameter in series, and relates to a processing method using the machine.

2. Description of the Prior Art

An electronic part such as integrated circuit (IC), large-scale integration (LSI) or very large-scale integration (VLSI) are assembled using a small piece of semiconductor device chip on which a very fine electric circuit is drawn as a main part. Said semiconductor device chip is made from a thin wafer which is prepared by slicing a mono-crystalline ingot of silicon or other compound semiconductor. Recently, the size of silicon or other compound semiconductor wafer (hereinafter shortened to wafer) is becoming bigger in response to the requirement to improve productivity and productive efficiency. Especially, in a case of silicon wafer, since the manufacturing technique of silicon mono-crystalline ingot which is the starting material is remarkably improved, big size wafers of 12 inch or 16 inch diameter are beginning to be prepared on an industrial scale.

A wafer sliced from an ingot is processed by a lapping process, an etching process and then by a polishing process to generate a mirror finish wafer, i.e. at least one surface is mirror finished. The object of a lapping process is to improve a form accuracy of as cut wafer which has uneven surface after being sliced and to form a standard surface. The object of a polishing process is to improve the surface roughness. In general, to perform good productivity and high productive efficiency, a conventional lapping or polishing machine is designed to process plural numbers of wafer at the same time. Concretely, a lapping machine which has big cast iron platens or a polishing machine which has platens with polishing pad on upper and lower part of machine are generally used, and plural numbers of wafer are held by carrier plates. At the actual processing, plural numbers of wafer held by carrier plates are put between upper and lower platens and pressed. The platens and wafer are rotated, while fluid for processing which contains fine particles of abrasive is supplied and wafers are processed. At the final mirror finishing process, usually only one necessary side surface is processed.

Along with the recent increase in growth of the wafer size, a bigger processing machine which processes plural numbers of bigger size wafers at the same time becomes necessary. However, along with the increase in size of the processing machine, not only does the requirement for form accuracy and dimensional stability of the machine become more severe, but also the handling difficulty of loading and unloading of wafers becomes more troublesome. Therefore, it becomes difficult to expect good productivity and high productive efficiency from a bigger size processing machine.

To solve the above mentioned problem of a bigger size machine, recently a sheet feeding type wafer processing machine which processes wafers one at a time is becoming popular. For example, a double-disc surface grinding machine which uses two diamond grinding wheels is used as a sheet feeding type wafer processing machine. Diamond wheels are rotated at a high rotating speed and a grinding fluid is supplied, while wafers are supplied through a feeding system. In this case, since a wafer is processed by a grinding mechanism, it is difficult to achieve the purpose of obtaining a mirror finish surface which can be obtained by polishing.

After fine and complicated electric circuit is engraved on a mirror finished surface of wafer in a device procedure, the wafer is divided into small unit chips. Before the dividing process, a wafer is processed maintaining the original circular shape, and among the key processes there are additional procedures such as washing, rinsing, drying and transferring. Through these procedures, if the shape of outermost periphery of the wafer is sharp, sheer and coarse, these Portions of the wafers contact each other or the machine and cause fine cracks which generate fine particles, or fine contamination particles cover the coarse surface of the edge part of the wafer. These generated fine particles are scattered during the latter procedure, contaminate fine processed surfaces of wafers and affect significantly the yield and the quality of products. In general, to avoid said phenomenon, the sharp outermost periphery of wafer is dulled by a beveling wheel, then the dulled part is mirror finished (edge polishing).

However, if the edge polishing is carried out at the earlier stage, the polished edge surface can be easily damaged and contaminated at the latter procedure, and causes re-contamination which affects significantly the yield and the quality of products. Namely, since the polishing of a wafer surface and an edge surface are carried out independently as different procedures, these above mentioned problems arise.

BRIEF SUMMARY OF THE INVENTION

The inventors of the present invention, have carried out an intensive study to solve the above mentioned problems, that is, problems which accompany the processing of big size wafers relating to edge polishing, and accomplished the wafer processing machine and a processing method of this invention. The object of this invention is to provide a sheet feeding type wafer polishing machine which processes both surfaces and an outermost periphery of wafer in series. And another object of this invention is to provide a processing method using said polishing machine.

The above mentioned object can be accomplished by a wafer processing machine having two platens which have adhered thereto a polishing pad or a grinding stone and which hold a wafer therebetween. The processing machine processes the surface of the wafer by rotating at least one of said two platens and wafer, wherein the diameter of the platens are bigger than the radius and smaller than the diameter of said wafer, and the wafer is supported by at least three guide rollers which contact the outermost periphery of the wafer. Preferably, at least one of the guide rollers is a polishing roller. Further, an other object of this invention is accomplished by a wafer polishing method comprising, a wafer whose both surface are lapped and whose outermost periphery is processed by a beveling wheel. An etched wafer is sent to the processing machine, double faced platens of said processing machine are pressed to the wafer and rotated, a driven polishing roller is rotated at a speed such that the periphery speed of the groove part is faster than that of the outermost periphery of the wafer to polish the outermost periphery of wafer, then the driven roller is stopped and the rotating speed of the double faced platens is increased and both surfaces of the wafer are polished.

In the polishing machine of this invention, the polishing roller can be a driven roller or a free rotating roller as needed. Further, the kind polishing pad is not limited, however, it is desirable to use a synthetic resin foam, non woven cloth, resin treated non woven cloth, synthetic leather or a composite product thereof. Still further, referring to the grinding stone, it is not intended to be limited, but it is desirable to use a soft type synthetic grinding stone in which abrasives are fixed by low bondage resin. Furthermore, the two platens of the polishing machine of this invention can be placed horizontally or vertically.

Figure 1:
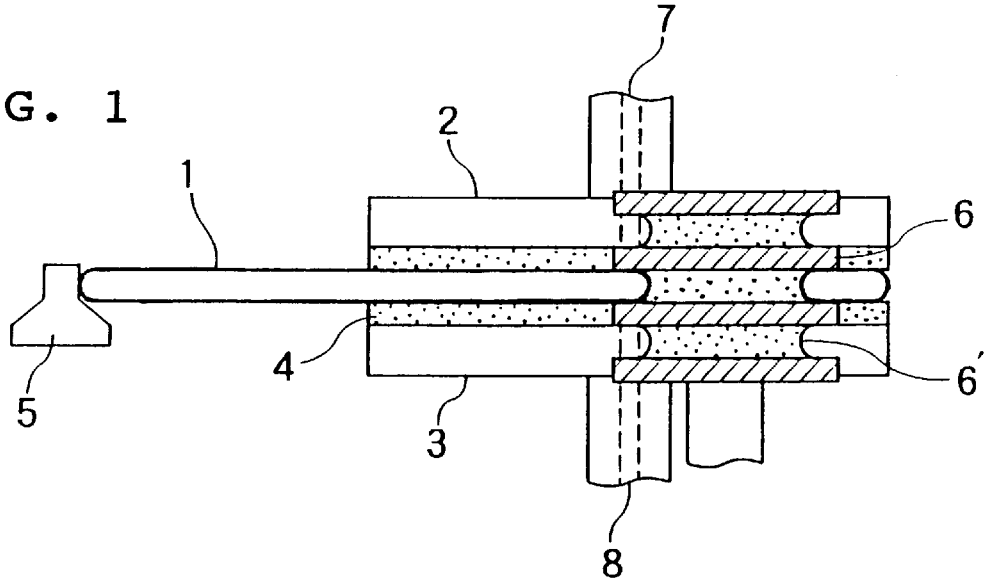
FIG. 1 is the side view of the wafer processing machine of this invention.

In the drawings, each numerical number indicates,

1: wafer,
2: upper platen,
3: lower platen,
4: polishing pad,
5,5': guide roller,
6: polishing roller,
6': grove of polishing roller,
7: compound supplying hole (upper platen),
8: compound supplying hole (lower platen),
9: tank

DETAIL DESCRIPTION OF THE INVENTION

The present invention will be illustrated more in detail with reference to the attached drawings. However, the invention is not intended to be limited by drawings.

Figure 2:
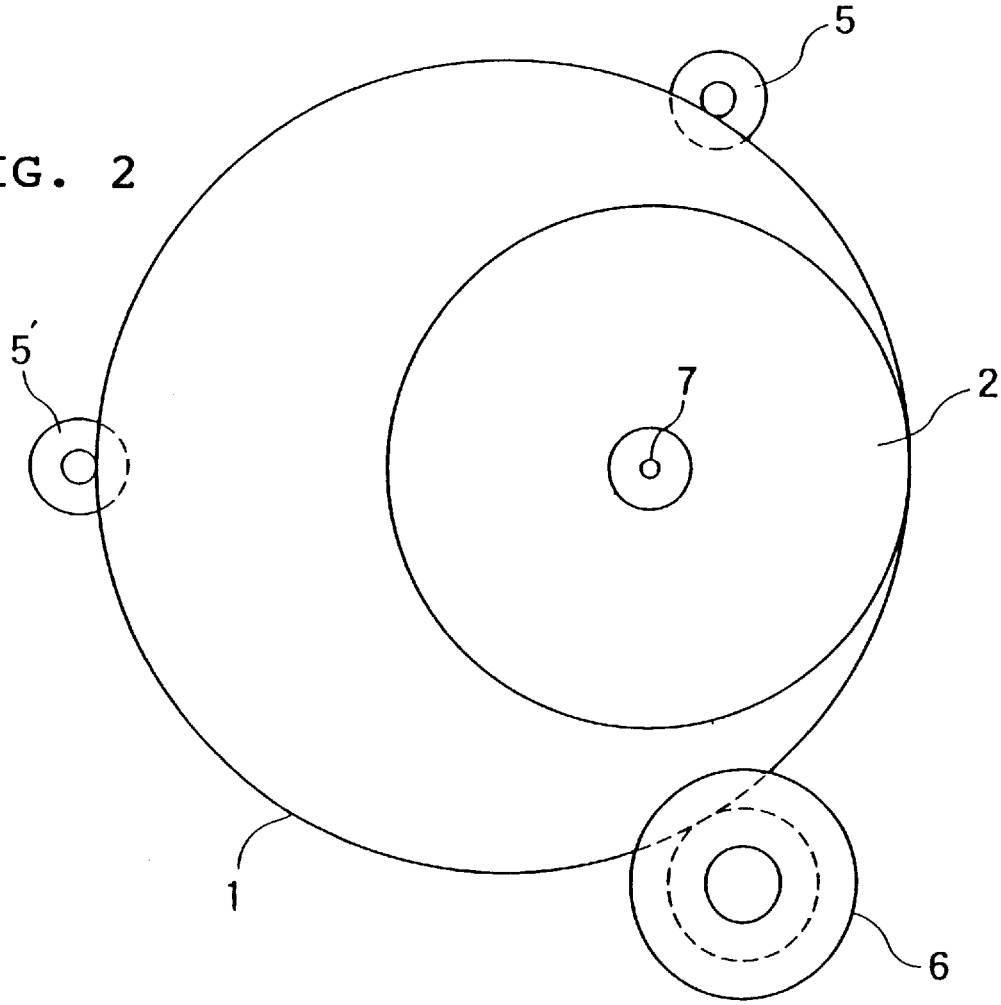
FIG. 2 is the plan view of the wafer processing machine of this invention.

FIG. 1 is a side view of one example of the wafer processing machine of this invention. FIG. 2 is a plan view of processing machine of this invention.

The FIG. 1 and FIG. 2 are examples of the invention which show the type of machine in which the double faced platens are arranged horizontally. The outermost periphery of a circular wafer 1 is supported by guide roller 5, 5' and a polishing roller 6. The surface of the wafer is held between an upper platen 2 and a lower platen 3 whose surfaces have adhered thereto polishing pad 4. The groove part 6' of the polishing roller 6 has adhered thereto the same materials as the polishing pad 4. A slurry which contains abrasives for carrying out the processing is supplied to the surface of the machine through the supply holes 7 and 8 which extend through the center of upper and lower platen. The upper platen 2 and lower platen 3 are independently driven by individual driving motors (not indicated in the drawing), and also the polishing roller 6 is independently driven by an individually established driving motor (not indicated in the drawing). Since the guide rollers 5, 5' and the polishing roller 6 are established to support the outermost periphery of the wafer and to maintain the dimensional stability of the wafer, these rollers have a function to hold the wafer by adequate pressure and the holding pressure can be controlled as needed.

The wafer 1 is rotated accompanied with the rotation of upper platen 2 and lower platen 3, and the rotation can be controlled by regulating the holding pressure of said guide rollers 5, 5' and the polishing roller 6. Since the wafer 1 rotates accompanied with the rotation of platens, the position of wafer 1 which faces to the upper and lower platens 2, 3 traverses gradually. In this invention, the diameter of the upper and lower platens 2, 3 is bigger than the radius of the wafer 1. Therefore, although the surface area of each platen is smaller than that of wafer 1, the platen can cover the whole surface of the wafer during the processing, and can avoid a problem that an unprocessed portion remains or a problem of uneven processing. If the diameter of platens are not bigger than the radius of wafer, the platens can not cover the whole surface of wafer, and a problem of uneven processed surface arises which is caused by the difference of the periphery speed of the outer periphery part and the center part of platens. Further, if the diameter of platens is bigger than that of the diameter of wafer, the construction of the machine becomes different from that of this invention.

In the example of the invention shown in FIG. 1 and FIG. 2, the compound for processing is supplied through the supply holes 7 and 8 which extend through the center of upper and lower platen and spread to whole respective surface of the wafer homogeneously by centrifugal force accompanied with the rotation of platens. It is desirable to form grooves of radial or spiral shape on the surface of a polishing pad or a grinding stone to make the spreading of the processing compound more smooth.

Figure 3:
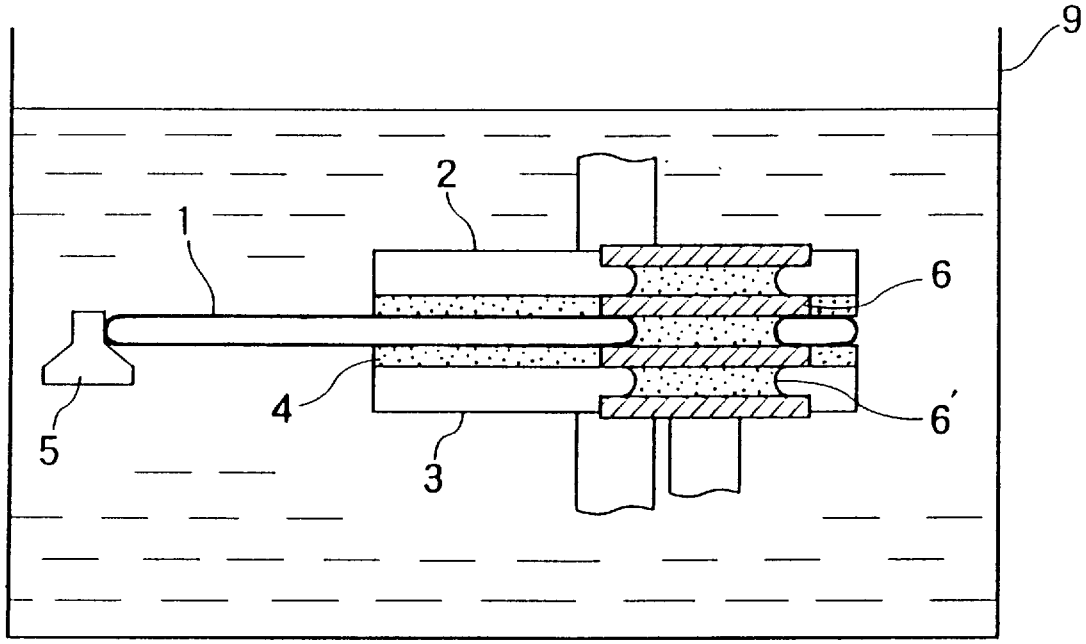
FIG. 3 is the side view of another example of the wafer processing machine of this invention.

FIG. 3 is a drawing which shows another example of the invention, wherein the main parts of this machine are dipped into a tank 9. In the tank 9, the compound necessary for processing, for instance, slurry type compound containing colloidal silica is contained in the liquid in the tank. In this case, since all procedures for processing are carried out in this tank, it is not necessary to provide supply holes through platens. Further, in this case, the processing compound exists homogeneously on the whole surface of the wafer.

The method for processing of the wafer by the wafer processing machine of this invention is illustrated and discussed with reference to FIG. 1 and FIG. 2.

The same kind of polishing pad is adhered to the surface of the upper and lower platen 2, 3 and to the surface of groove 6' of the polishing roller 6. Both surfaces of the wafer are lapped. The outermost periphery of the wafer is ground by a beveling wheel, and then the wafer is etched by an etching process. The etched wafer 1 is provided as a specimen and sent to the machine indicated by FIG. 2 and 3. The wafer 1 is supported by two guide rollers 5, 5' and a polishing roller 6. Double faced upper and lower platens are pressed to the surface of wafer 1 and rotated. The wafer 1 is rotated accompanied with the rotation of platens. The polishing roller 6 is rotated in a manner such that the periphery speed of groove 6' is faster than that of the rotating speed of the outermost periphery of the wafer with constant or intermediate supply of the processing compound for processing and polishing the outermost periphery of the wafer. After the polishing of outermost periphery of wafer, the driven rotation of the polishing roller 6 is stopped and the polishing roller 6 becomes a free rotating roller, and then the pressure of guide roller is reduced. The rotating speed of the upper and lower platen supply the processing compound through the supply holes 7 and 8, and polish both surfaces of the wafer. The desirable pressure for polishing is from 100 to 500 g/cm$^2$, and the desirable rotating speed of the platens is from 100 to 1000 rpm.

The present invention will be understood more readily with reference to the following Example. However, the Example is intended to illustrate the invention and not be construed to limit the scope of the invention.

EXAMPLE

SUBA 400 (product of Rodel-Nitta) whose thickness is 1.27 mm is used as the polishing pad, and is adhered to the surface of upper and lower platen and to the groove surface of the polishing roller. In this case, the diameter of the upper and lower platen is 170 mm. Weak alkaline slurry type compound mainly composed by colloidal silica is supplied as polishing compound and an etched wafer of 300 mm diameter is polished by this machine. The polishing pressure is 100 g/cm$^2$ and the rotating speed of the platens is 600 rpm. The whole surface and outermost periphery of the wafer are perfectly polished, and the defects such as uneven surface, scars or scratches are not observed on the polished surface. Surface roughness Ra after polishes is 3~5 Å.

As illustrated above, in the field of precision processing of semi conductor materials such as a silicon wafer, it becomes possible to process both surfaces of the wafer and outermost periphery of the wafer in series by the sheet feeding type wafer processing machine of this invention. Further, by this machine, it becomes possible to overcome the problem of troublesome handling accompanied with the processing of large size wafers, and additionally, the processing machine becomes lighter and more compact. By this machine, the connection of processing machines in series with other processing machines is more easily achieved as compared with other conventional type machines. Thus the effect of this machine is obvious.

What is claimed is:

1. A wafer processing machine having two circular platens and a polishing pad or a grinding stone adhered thereto and holding a circular wafer therebetween, said wafer having two surfaces, a diameter, a radius and an outer periphery edge, wherein said processing machine processes the surface of said wafer by rotating at least one of said two platens and wafer, wherein the diameter of said platens are bigger than the radius of said wafer and smaller than the diameter of said wafer, and said wafer is supported by at least three guide rollers which contact the outermost periphery of said wafer, wherein at least one of said guide roller is a polishing roller.

2. The wafer processing machine of claim 1, wherein the polishing roller is a driven driving roller.

3. The wafer processing machine of claim 1, wherein the polishing pad is at least one selected from the group comprising synthetic resin foam, non woven cloth, resin treated non woven cloth, synthetic leather or a composite product thereof.

4. The wafer processing machine of claim 1, wherein the grinding stone is a synthetic grinding stone in which colloidal silica is an abrasive.

5. A wafer processing method comprising sending a circular wafer, whose both surface are lapped and whose outermost periphery has been processed by a beveling wheel and then etched, to a processing machine having double faced platens, pressing the double faced platens of said processing machine to the wafer and rotating the platens, driving a driven polishing roller at a rotating speed such that the periphery speed of a groove part of the polishing roller is faster than that of the outermost periphery of the wafer to polish the outermost periphery of the wafer, then stopping the drive of the driven roller, increasing the rotating speed of the double faced platens and polishing both surfaces of the wafer.

* * * * *